US007401618B2

(12) United States Patent
Caldwell

(10) Patent No.: US 7,401,618 B2
(45) Date of Patent: Jul. 22, 2008

(54) UMBRELLA WITH A VENTED CANOPY DEPLOYABLE AND RETRACTIBLE TO A DIHEDRAL SHAPE WITH A POSITIVELY MOVED CANOPY AND VENT COVER

(76) Inventor: John W. Caldwell, 1829 Warwick Rd., San Marino, CA (US) 91108

( * ) Notice: Subject to any disclaimer, the term of this patent is extended or adjusted under 35 U.S.C. 154(b) by 148 days.

(21) Appl. No.: 11/507,719

(22) Filed: Aug. 21, 2006

(65) Prior Publication Data

US 2008/0041433 A1 Feb. 21, 2008

(51) Int. Cl.
*A45B 25/18* (2006.01)

(52) U.S. Cl. ..... 135/33.7; 135/33.2

(58) Field of Classification Search ..... 135/15.1, 135/20.1, 28, 33.2, 33.7
See application file for complete search history.

(56) References Cited

U.S. PATENT DOCUMENTS

| | | | | | |
|---|---|---|---|---|---|
| 212,457 | A | * | 2/1879 | Girbardt | 135/33.7 |
| 3,374,798 | A | * | 3/1968 | Samuelson | 135/33.7 |
| 3,388,712 | A | * | 6/1968 | Taylor | 135/98 |
| 6,068,008 | A | * | 5/2000 | Caldwell | 135/99 |

* cited by examiner

*Primary Examiner*—David R Dunn
*Assistant Examiner*—Danielle N Jackson
(74) *Attorney, Agent, or Firm*—Donald D. Mon

(57) ABSTRACT

An umbrella assembly providing a dihedral shelter atop a pole which can be deployed to different dihedral angles and retracted to a compact configuration. It further includes a vent port in a cavity which is overhung by a positively positioned vent port cover.

8 Claims, 7 Drawing Sheets

UMBRELLA WITH A VENTED CANOPY DEPLOYABLE AND RETRACTIBLE TO A DIHEDRAL SHAPE WITH A POSITIVELY MOVED CANOPY AND VENT COVER

FIELD OF THE INVENTION

A foldable, retractable umbrella having a vented canopy deployable to a dihedral shape, and a vent cover overhanging the vent in the canopy, deployable to a dihedral strip, both by dedicated arms, the dihedral angle being adjustable.

BACKGROUND OF THE INVENTION

This invention is directed to larger umbrellas commonly used for shading in outdoor settings such as parties, pool sides, and outdoor dining areas. It is collapsible in the sense of being retractable for storage, and deployable to its working configurations.

The working configuration of this invention is a dihedral canopy structure, folded along a dihedral edge. The dihedral angle is adjustable, and at one extreme may be 180 degrees (a flat plane), although the selected dihedral angle will most usually be less, resulting in two slanted panels, often with about 120 degrees included between them.

Such structures are usually mounted on stands and are subject to substantial wind loads which might overturn them. It is customary to provide a vent port in the canopy to reduce the differential pressure across it. In ordinary umbrellas, the size of the vent port must be kept quite small. It is an object of this invention to provide an arrangement in which the vent port can be made much larger by providing a vent cover whose deployed configuration is established by dedicated adjustable structure to assure that the vent cover will remain reliably open and in place, both to provide the vent function and to assure that the vent cover will reliably overhang the vent port.

There results an umbrella with a desirable and attractive configuration with an improved vent system in a conveniently-attained deployed condition, and which can readily be retracted to a conveniently carried and stored configuration.

BRIEF DESCRIPTION OF THE INVENTION

The umbrella includes an upright central pole which can be supported on a stand or other structure. A central first hub is fixed to the pole at the top, where it hingedly mounts three groups of arms: (1) a pair of ridge former rods, (2) two pairs of two each canopy rods; and (3) one pair of vent cover rods.

A second hub, this one fitted slidably along the pole hingedly mounts a pair of respective ridge former struts, each of which in turn is hingedly mounted to a ridge former rod.

A third hub, also fitted slidably along the pole, hingedly mounts two pairs of canopy struts which in turn are hingedly mounted to respective canopy rods, and also to a pair of vent cover struts that are in turn hingedly mounted to respective vent cover rods.

The canopy has a vent port at its center, and the vent cover has lateral dimensions to overhang it. The canopy is attached to the ridge formers, and the vent cover is fastened to the canopy along the ridge line. The canopy is attached at its corners to the canopy rods near their ends, and the vent cover is attached to the vent cover rods near their ends, spaced from the ridge lines.

The canopy and the vent cover are flexible and foldable. When the umbrella is deployed they will be stretched and positioned in accordance with where the third hub is located along the pole, assuming that the second hub has been placed where the ridge former rods will be deployed.

As a consequence this umbrella may be deployed conveniently, and can as conveniently be retracted, with the vent positively open at all deployed positions.

The above and other features of this invention will be fully understood from the following detailed description and the accompanying drawings, in which:

DETAILED DESCRIPTION OF THE INVENTION

Figure 1:
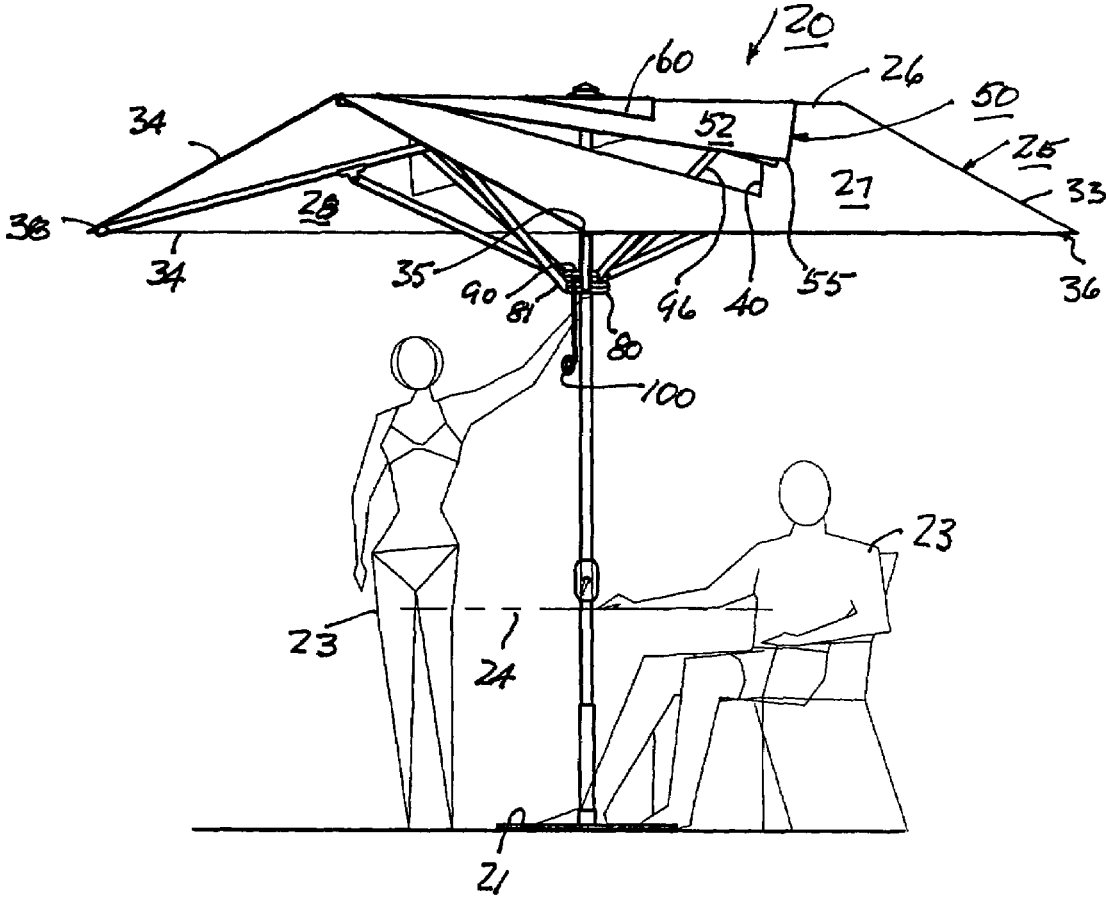
FIG. 1 is a side view of the preferred embodiment of an umbrella according to the invention in one of its deployed conditions.

FIG. 1 shows the preferred embodiment of this invention in its most frequently deployed position. An umbrella 20 is mounted to a stand 21 to support a central pole 22 with the axis in an upright position. Instead of a stand, sockets or other types of support can as readily be used. Persons 23 and objects such as tables and chairs can conveniently be sheltered under the umbrella. A table 24 is suggested by a broken line in FIG. 1.

As shown in FIG. 1, the umbrella includes a canopy 25 which is preferably rectangular so that when deployed it will form a dihedral angle with a ridge 26 (more properly, an "edge" of a dihedral) with a pair of rectangular faces 27, 28. It is a feature of this invention that the dihedral angle between the faces can be adjusted, even to the extent that it is 180 degrees (a flat plane). More usually the dihedral will be on the value of about 120 degrees.

It is of interest that with this rectangular arrangement, a 9 foot by 9 foot square umbrella can provide as much shade as an 11 foot diameter round umbrella. This can provide important advantages when placing tables and umbrellas in rows, giving them as much shade with minimized side interference and greater uniformity.

The canopy is made of flexible material so it can be bent or folded. Most common fabrics have some limited elasticity, which assists the canopy to form flat panels when stretched at the corners. Woven fabric is a recognized material for such fabrics. The canopy (shown as a flat layout in FIG. 3) has outer edges 31,32,33 and 34, generally arrayed as a rectangle or square although there may occasionally be reasons to form them other than as straight lines. These edges form four corners 35,36,37 and 38.

In the center of the canopy an open vent port 40 is formed. As will be evident, it is convenient for it to be formed as a rectangle or square but this is not a limitation on the invention. Preferably in plan view it is disposed at a 90 degree angle to the outside perimeter of the canopy. The vent port has edges 41,42,43 and 44.

A vent cover 50 rests stop the canopy, with a perimeter 51 geometrically similar to the vent port, but with larger lateral dimensions so that it will overhang the vent port, especially when the umbrella is deployed. It is made of material similar to the canopy and is locally attached to the canopy at places to be described below. Of particular interest is that a triangular cover panel 52,53 is formed loosely on each side of the ridge line 26 with corners 55 and 56 farthest from the ridge line.

A cap 60 is attached to the pole above the canopy and vent cover so as to cover and protect the first hub and the pole from drainage. Except at its center it is loose from the vent cover, and is not relied on for a venting function.

Figure 2:
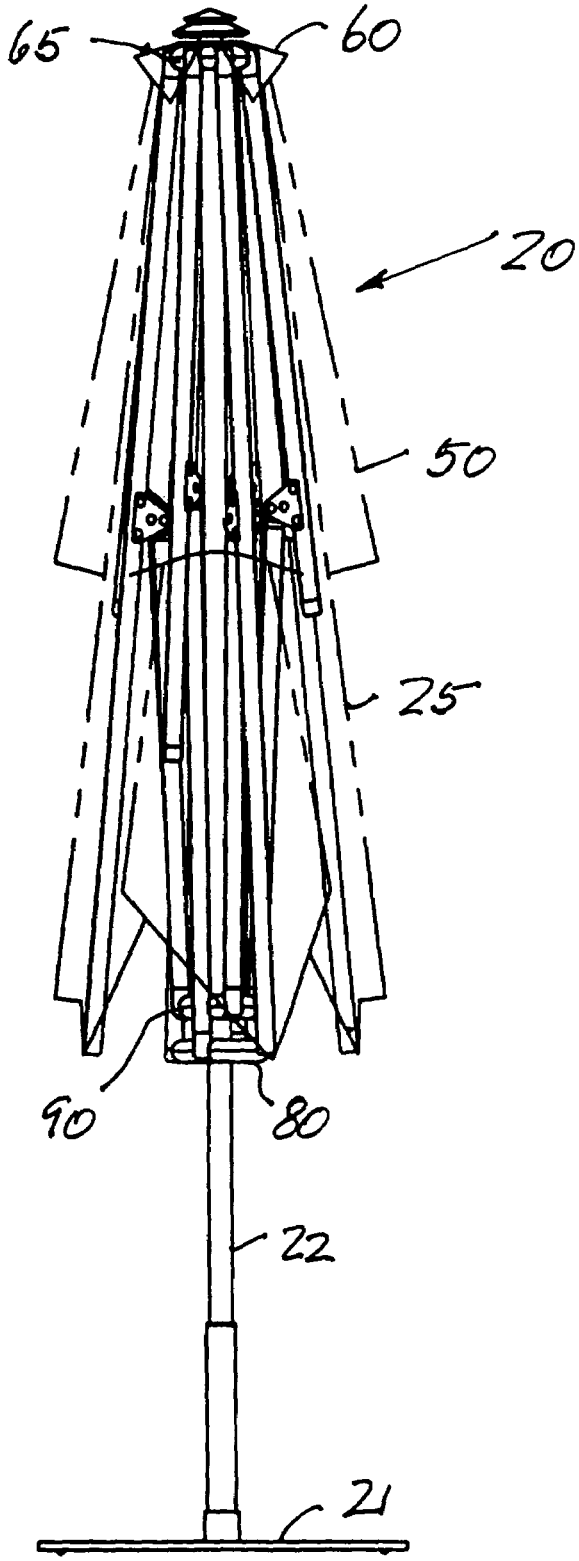
FIG. 2 is a side view of the umbrella in its retracted condition.

As shown in FIG. 2, which illustrates the retracted condition, the cap, vent cover and canopy are all suspended in various direct and indirect ways from the pole. Deployment is accomplished by selective movement of the second and third hubs whose movement along the pole deploys or retracts these flexible sheets.

Deployment and retraction are accomplished by changing the axial location of hubs along the pole. A first hub 65 is fixed at or near the top of the pole. As best shown in FIGS. 4-7, which show the actuator structure without the canopy or vent cover for clarity, this first hub provides hinges for eight rods. Ridge former rods 66 and 67 are hinged at one end for vertical movement (as do all of the rods described herein) and extend radially away from one another. When deployed they will be horizontal and will form the ridges the canopy and vent cover draping over them.

Two pairs of canopy rods 70, 71, 72,73 are hinged to the first hub and extend away in the direction of canopy corners, as will become apparent.

One pair of vent cover rods 74,75 is hinged to the first hub, extending in the direction of cover corners.

A second hub 80 is slidably fitted on the pole for movement up and down along it. This hub is for the purpose of controlling the ridge former rods. Two ridge former struts 81 and 82 are hingedly connected to the second hub and to a mid location on respective ridge former rods. Thus, up and down movement of the second hub will move the struts to cause the ridge former rods to deploy to form the ridge or retract to collapse the umbrella.

A third hub 90 is similarly slidably fitted on the pole. It is for the purpose of controlling the position of the canopy rods and the vent cover rods. This hub is effective when the second hub is raised. For this purpose, two pairs of canopy struts 91,92,93,94 are hingedly mounted at one end to the third hub and at the other end to mid positions on the canopy rods. Up and down movement of the second hub raises and lowers the ridge former rods.

A pair of vent cover struts 96,97 are also hingedly attached to the third hub at one of their ends. Their other end is hingedly attached to a mid point on a respective vent cover rod. These struts pass through the vent port to move the vent cover rods.

For clarity of disclosure the canopy and vent cover are either omitted from some drawings, or shown only in thin line. The umbrella is assembled by attaching rods to the canopy and vent cover and attaching the vent cover to the canopy at the ridge, as will be disclosed.

There are three basic conditions of this umbrella. The retracted condition is shown in FIG. 2. The first hub is fixed, the second and third hubs are at their lowest position. All struts and rods have been retracted and brought toward the pole. the fabric material (canopy and vent cover) are sufficiently attached that all hangs down loosely, but are suspended.

Figure 3:
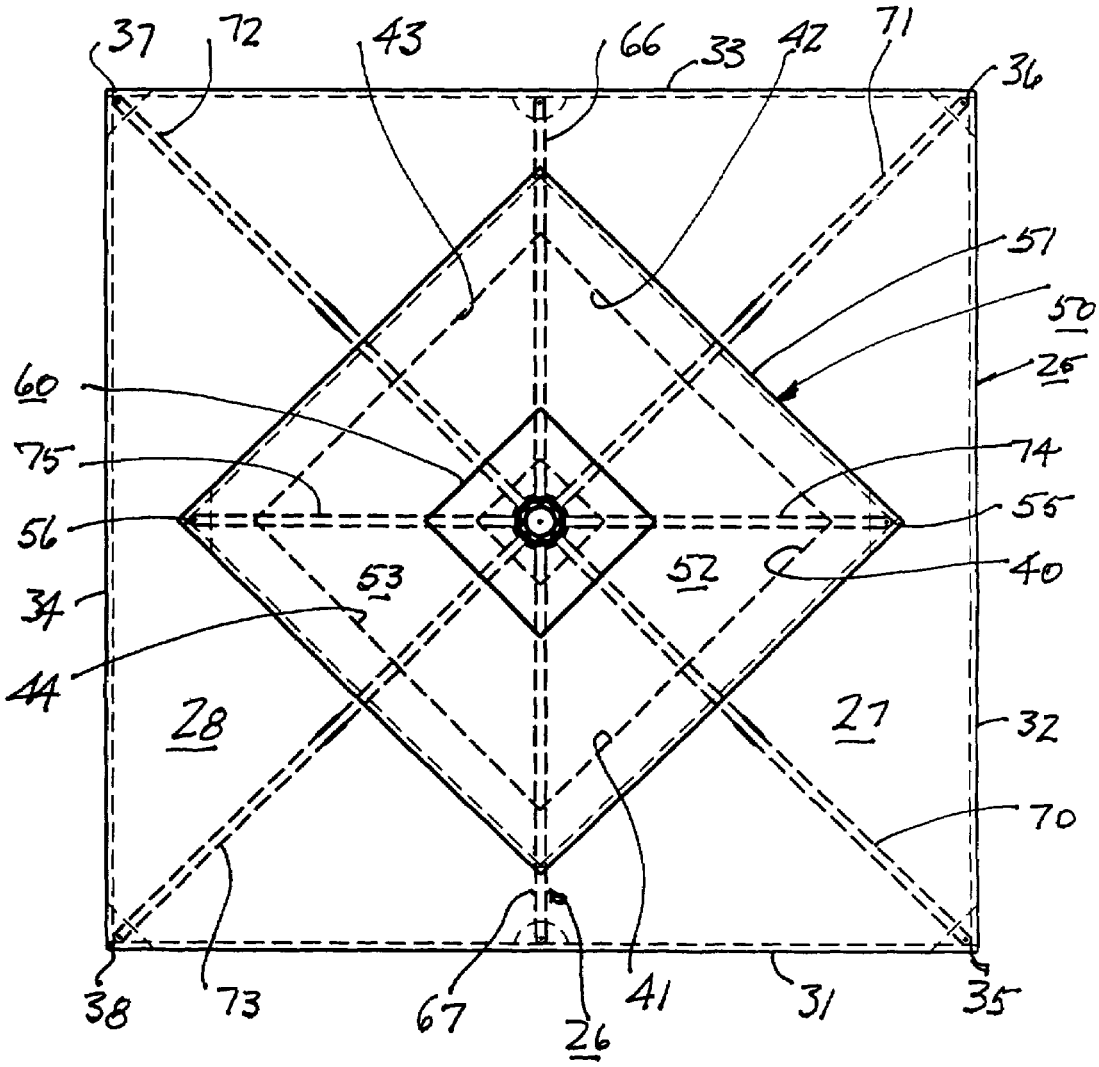
FIG. 3 is a flat plane view of the canopy, vent cover and cap, laid flat.
Figure 4:
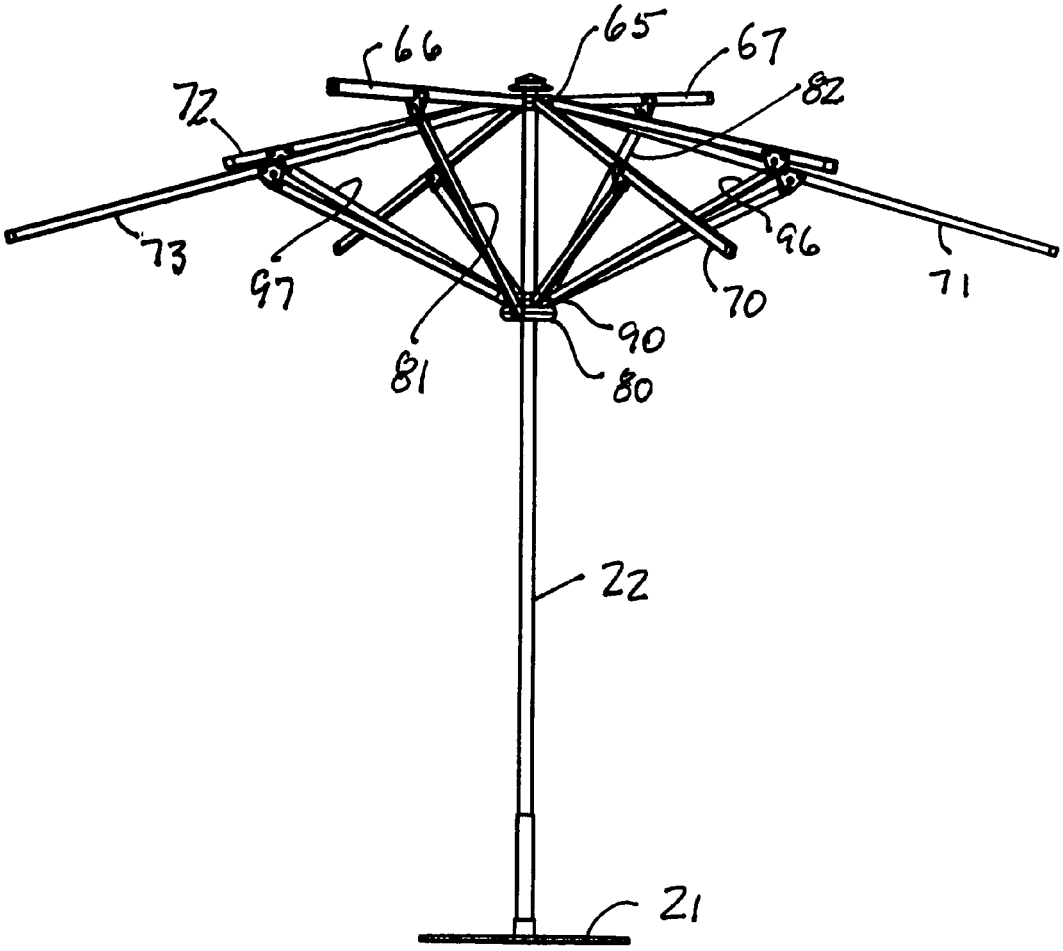
FIG. 4 is an off axis view of the actuator structure in one dihedral condition.

To deploy the umbrella to the position of FIG. 1, both the second and third hubs rise together and stop at the position shown in FIGS. 3 and 4. The second hub (for the ridge former rods) will always stop here. A stop such as a pin or other mechanism (not shown) to restrain them from lowering will be supplied for this.

To raise the canopy further, the third hub must be raised higher, leaving the second hub where it is. If the height of the third hub is at an inconvenient reach, a wand 100 may be attached to it, hanging down where it can be grasped and pushed upwardly to raise the third hub. A handle 101 is provided for this. Also, if desired a restraint 102 can be provided to rest on the second hub when the canopy is flat, to hold the third hub in its raised position at that time.

Figure 5:
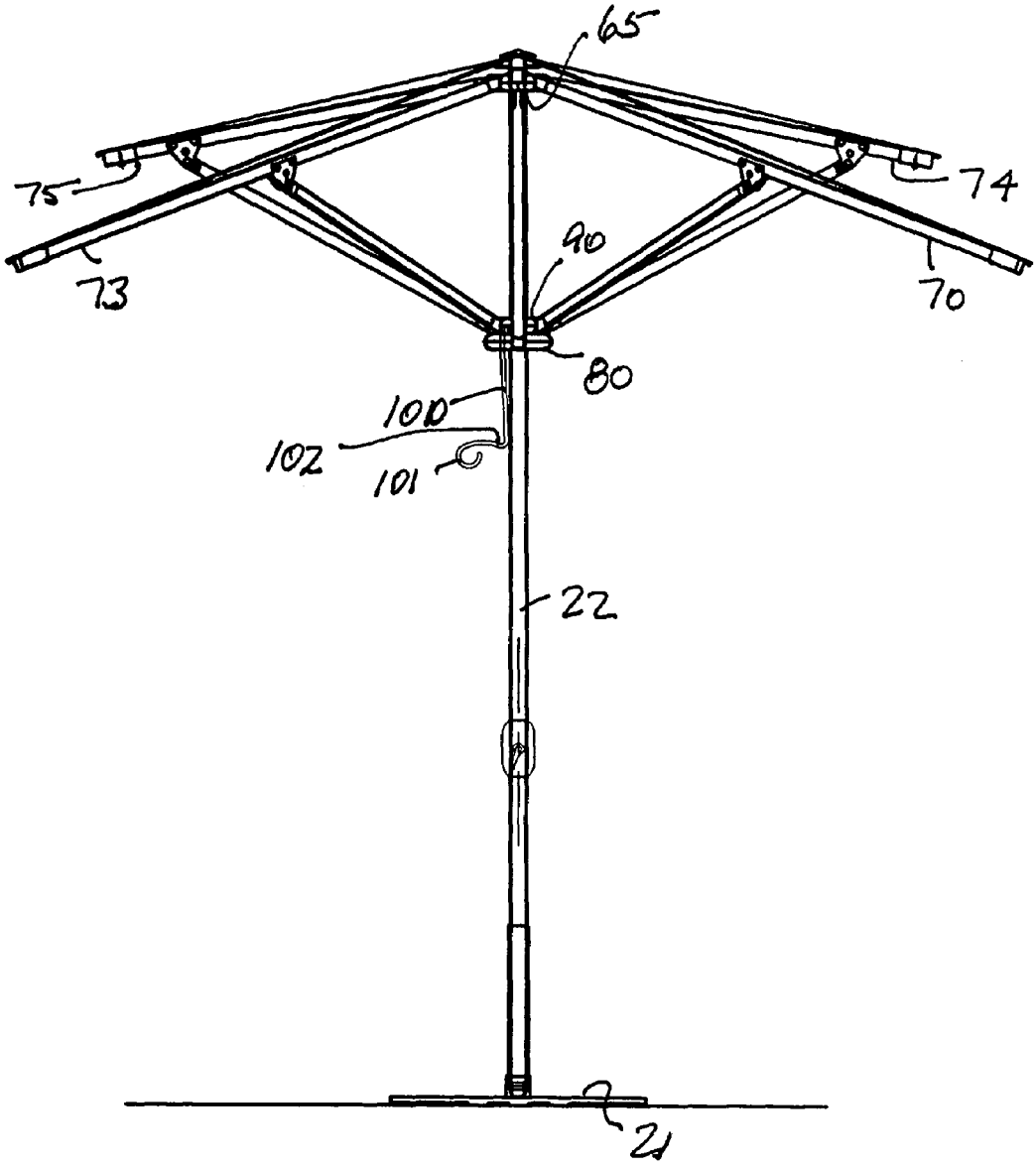
FIG. 5 is a side view of the condition of FIG. 4.
Figure 6:
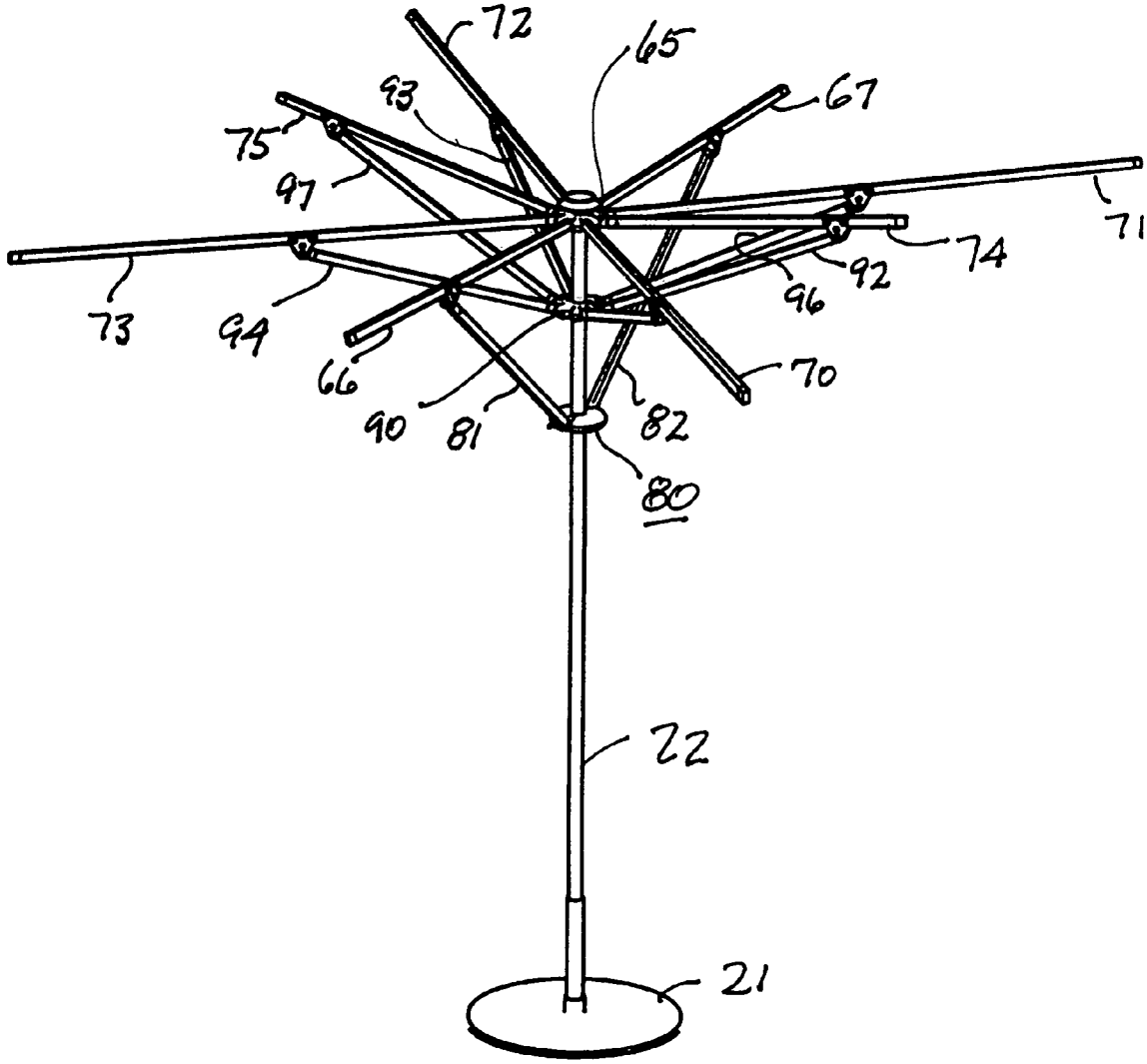
FIG. 6 is an off axis view of the actuator structure in another (flat) dihedral condition.
Figure 7:
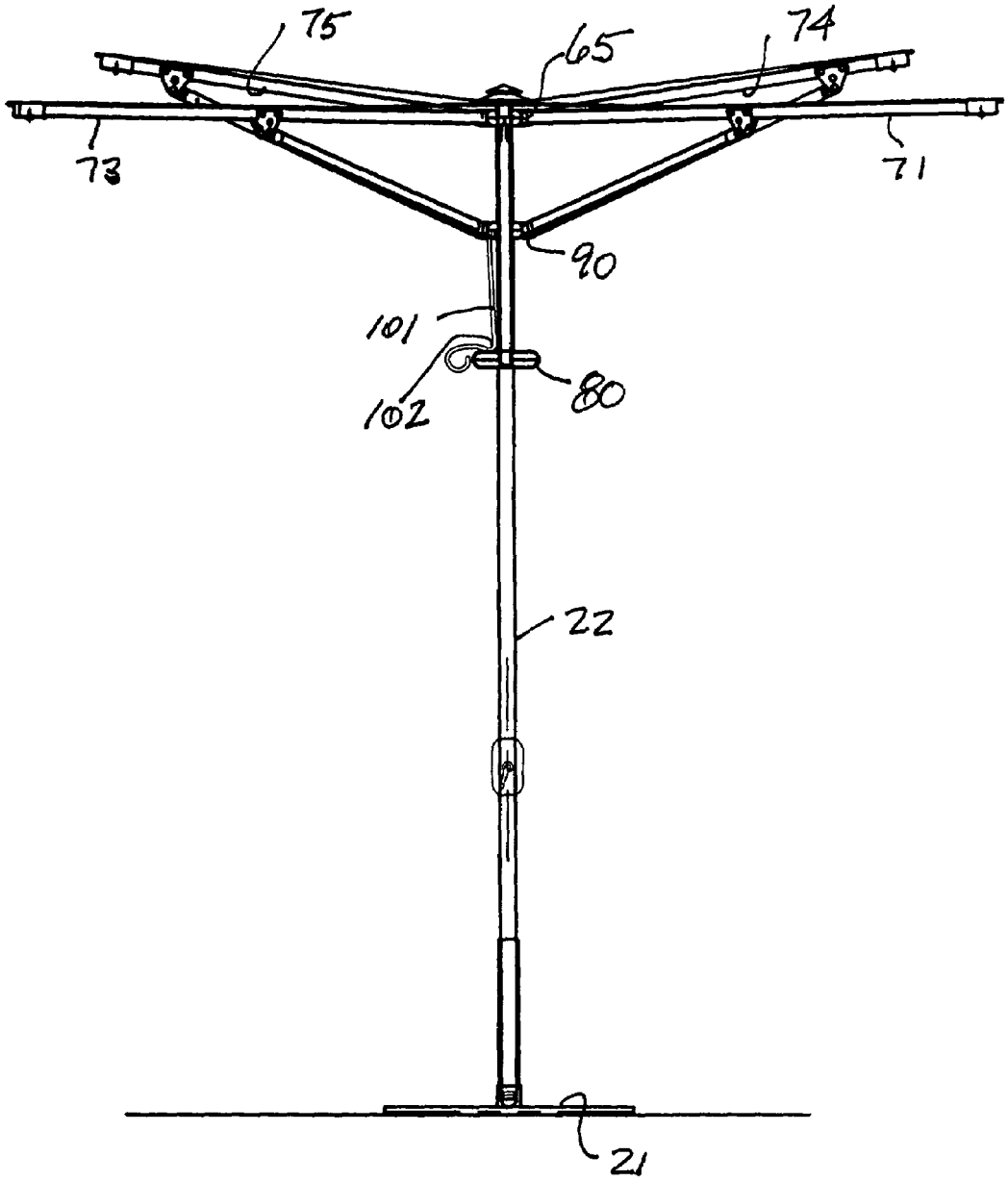
FIG. 7 is a side view of FIG. 6.

A comparison of FIGS. 5 and 7 illustrates the differences in positions of the rods and struts in the two deployed conditions. What is of most importance is that the vent cover moves when the canopy moves, and is always under positive position control.

As to attachment of the canopy and vent cover to the rods, the remote, second ends of the canopy rods will be placed in pockets, or otherwise attached to the canopy near its corners. The vent cover rods will be placed in pockets or otherwise attached to the vent cover near the "points" removed from the ridge.

Attachment of the canopy to the ridge former rods is done to assure that the canopy is properly placed on the ridge and does not slide away when the umbrella is retracted. Fasteners (not shown) along the ridge will usually be used.

The vent cover must stay with the canopy, so it may be stitched or otherwise fastened to the canopy at suitable places along the ridge.

Positions intermediate between the dihedral of FIG. 1 and the flat plane of FIG. 7 may be used provided means is present to hold the third hub at a selected height between the two positions.

This invention provides a versatile and attractive umbrella with advantages of shape and deployed conditions, easy storage, and a rugged assembly. The various parts may be such as aluminum tubing and extrusions and plastic parts where advantageous, such as for hubs and hinges.

This invention is not to be limited by the embodiment shown in the drawings and described in the description, which is given by way of example and not of limitation, but only in accordance with the scope of the appended claims.

I claim:

1. A retractible and deployable umbrella assembly, comprising:

a flexible canopy which when flat has a generally rectangular perimeter and a central vent port having a perimeter;

a flexible vent cover which when flat has a perimeter that overhangs the perimeter of the vent port;

a central upright pole which passes through said vent port said pole having an axis; and an actuator to support, deploy, and retract said canopy and vent cover, said actuator comprising:

a first hub fixed to the pole at an upper elevation thereof;

one pair of ridge former rods, said rods being directed 180 degrees apart from each other across the first hub;

two pairs of canopy rods, each pair comprising two canopy rods, the members of each pair being directed 180 degrees apart from each other across the first hub and at an angle to each other as viewed in plan;

one pair of vent cover rods, said rods being directed 180 degrees apart from each other across the first hub;

said ridge former rods, canopy rods and vent cover rods each having a first end hinged to said first hub, and a second end removed from said hub, the hinged movement being primarily in a plane that includes the pole axis, a second hub, said second hub being slideably mounted on said pole below said first hub;

a pair of ridge former struts;

said ridge former struts being directed 180 degrees apart from each other across the second hub, each having a first end hingedly mounted to said second hub, and a second end hingedly mounted at a mid location on a respective ridge former rod;

a third hub, said third hub being slidably mounted on said pole between said first and second hubs;

two pairs of canopy struts, each pair comprising two canopy struts, each pair being directed 180 degrees apart from each other across the third hub, each having a first end hingedly mounted to said third hub and a second end hingedly mounted at a mid location on a respective canopy rod;

a pair of vent cover struts, said vent cover struts being directed 180 degrees apart from each other across the third hub, each having a first end hingedly mounted to said third hub, and the second end hingedly mounted at a mid location on a respective vent cover rod, each vent cover strut passing through said canopy;

said second ends of said canopy rods being fixed to said canopy;

said second ends of said vent cover rods being fixed to said vent cover; whereby with the foregoing assembly, and said ridge former rods deployed, the canopy is formed as a dihedral, stretched by said canopy rods over said ridge former rods, said vent covers being attached to said canopy at said ridge and stretched to overhang the vent port, with the vent cover tilted above said canopy, thus with said second hub and third hub raised together, the said dihedral angle will be less than 180 degrees; and with said second and third hubs fully lowered, said struts retract all of said rods and collapse the umbrella to a retracted condition.

2. An umbrella assembly according to claim 1 in which with said second hub positioned to deploy said ridge former rods, said third hub can be positioned to adjustably select said dihedral angle.

3. An umbrella assembly according to claim 1 in which with said third hub raised above said second hub, the dihedral angle is increased.

4. An umbrella assembly according to claim 3 in which said dihedral angle can become as large as 180 degrees.

5. An umbrella assembly according to claim 1 in which said canopy is attached to said ridge former rods along said ridge former rods and the vent cover is attached to the canopy along the position that forms the ridge.

6. An umbrella assembly according to claim 1 in which all of said struts are of such length and are hinged to respective rods in such relationships that when the second and third hubs are lowered to their fullest extent, all of the rods and all of the struts gather closely to the pole.

7. An umbrella assembly according to claim 6 in which with said second hub positioned to deploy said ridge former rods, said third hub can be positioned to adjustably select said dihedral angle.

8. An umbrella assembly according to claim 1 in which a flexible cap surrounds the pole above the canopy and vent cover to shield the pole from damage past the cap.

* * * * *